US011129268B2

(12) United States Patent
Kinoshita et al.

(10) Patent No.: US 11,129,268 B2
(45) Date of Patent: Sep. 21, 2021

(54) IGNITION APPARATUS INCLUDING SPARK PLUG THAT GENERATES PLASMA

(71) Applicants: DENSO CORPORATION, Kariya (JP); PLASMA APPLICATIONS CO., LTD., Hamamatsu (JP)

(72) Inventors: Shota Kinoshita, Kariya (JP); Fumiaki Aoki, Nishio (JP); Daisuke Tanaka, Nishio (JP); Akimitsu Sugiura, Kariya (JP); Jan Husarik, Hamamatsu (JP); Masashi Kando, Hamamatsu (JP)

(73) Assignees: DENSO CORPORATION, Kariya (JP); PLASMA APPLICATIONS CO., LTD., Hamamatsu (JP)

( * ) Notice: Subject to any disclaimer, the term of this patent is extended or adjusted under 35 U.S.C. 154(b) by 632 days.

(21) Appl. No.: 15/914,101

(22) Filed: Mar. 7, 2018

(65) Prior Publication Data

US 2018/0279460 A1 Sep. 27, 2018

(30) Foreign Application Priority Data

Mar. 8, 2017 (JP) ..... JP2017-044205

(51) Int. Cl.
*H05H 1/46* (2006.01)
*H05H 1/00* (2006.01)
(Continued)

(52) U.S. Cl.
CPC ..... *H05H 1/46* (2013.01); *F02P 3/01* (2013.01); *H01T 13/40* (2013.01); *H01T 13/50* (2013.01);
(Continued)

(58) Field of Classification Search
CPC .. H05H 1/00; H05H 1/24; H05H 1/20; H05H 1/22; H05H 1/46; H01J 37/32; F02P 3/00;
(Continued)

(56) References Cited

U.S. PATENT DOCUMENTS 4,087,719 A * 5/1978 Pratt, Jr. ..... H01T 13/20 123/169 EL
4,774,914 A * 10/1988 Ward ..... F02P 15/04 123/162
(Continued)

FOREIGN PATENT DOCUMENTS

JP 5-182597 7/1993

*Primary Examiner* — Thienvu V Tran
*Assistant Examiner* — Nusrat Quddus
(74) *Attorney, Agent, or Firm* — Nixon & Vanderhye P.C.

(57) ABSTRACT

An ignition apparatus is provided which ignites a mixture of air and fuel gas by plasma to generate an initial flame. The apparatus includes: a spark plug that includes an inner conductor, a cylindrical outer conductor that holds the inner conductor thereinside, and a dielectric that is provided between the inner conductor and the outer conductor, and that generates plasma in a plasma formation space between the inner conductor and the outer conductor; an electromagnetic wave power supply that generates an electromagnetic wave to apply electromagnetic wave power to the spark plug; an evaluation section that evaluates a state of formation of the plasma; a determination section that determines a matching object of the electromagnetic wave based on an evaluation result by the evaluation section; and a coupled state control section that controls a matching condition of the electromagnetic wave so that the electromagnetic wave matches the matching object.

13 Claims, 7 Drawing Sheets

(51) Int. Cl.

| | |
|---|---|
| ***H01T 15/00*** | (2006.01) |
| ***H01T 13/50*** | (2006.01) |
| ***F02P 3/01*** | (2006.01) |
| ***H01T 13/40*** | (2006.01) |
| ***H05H 1/52*** | (2006.01) |
| *H01T 13/52* | (2006.01) |

(52) U.S. Cl.
CPC ..... *H01T 15/00* (2013.01); *H05H 1/0006* (2013.01); *H05H 1/0062* (2013.01); *H05H 1/52* (2013.01); *H01T 13/52* (2013.01); *H05H 1/461* (2021.05)

(58) Field of Classification Search
CPC .... F02P 3/01; F02P 3/02; F02P 3/0435; F02P 3/05; F02P 3/051; F02P 3/055; F02P 3/0552; F02P 3/0556; F02P 3/12; F02P 1/00; F02P 1/08; F02P 1/083; F02P 23/045; F02P 13/00; H01T 13/00; H01T 13/02–06; H01T 13/08; H01T 13/16; H01T 13/39–44; H01T 13/46; H01T 13/462; H01T 13/465; H01T 13/467; H01T 13/58; H01T 13/60; H01T 19/04
See application file for complete search history.

(56) References Cited

U.S. PATENT DOCUMENTS 5,394,061 A 2/1995 Fujii
9,228,559 B2 * 1/2016 Ikeda ..... F02P 23/045
2005/0009347 A1 * 1/2005 Matsumoto ..... H01J 37/32935 438/689
2006/0048732 A1 3/2006 Schmidt et al.
2007/0181528 A1 * 8/2007 Koroyasu ..... H01L 21/31116 216/59
2008/0018216 A1 * 1/2008 Camilli ..... H01T 21/02 313/141
2008/0190893 A1 * 8/2008 Mori ..... C23F 4/00 216/61
2010/0196208 A1 * 8/2010 Makita ..... H05H 1/52 422/83
2011/0146619 A1 * 6/2011 McAlister ..... F02D 37/02 123/297
2012/0097140 A1 * 4/2012 Kusunoki ..... H01T 13/32 123/620
2012/0173117 A1 * 7/2012 Serizawa ..... F02P 23/045 701/101
2012/0176723 A1 * 7/2012 Ikeda ..... F02P 9/007 361/253
2014/0014053 A1 1/2014 Kaneko et al.
2014/0145624 A1 5/2014 Ban et al.
2015/0340206 A1 11/2015 Ikeda
2016/0013623 A1 * 1/2016 Zheng ..... H01T 15/00 361/263
2016/0047352 A1 * 2/2016 Nakayama ..... F02P 3/0453 123/406.19
2016/0281674 A1 * 9/2016 Ikeda ..... H05H 1/52
2017/0045025 A1 * 2/2017 Nakayama ..... F02P 17/12
2017/0082083 A1 * 3/2017 Lowery ..... H01P 7/04
2017/0152830 A1 * 6/2017 Tinwell ..... H01T 13/40
2017/0328337 A1 * 11/2017 Ikeda ..... F02P 3/01
2018/0135506 A1 * 5/2018 Grover, Jr. ..... F02P 5/045
2018/0266382 A1 * 9/2018 Ikeda ..... F02P 23/045
2018/0291862 A1 * 10/2018 Forte ..... F02P 9/002

* cited by examiner

IGNITION APPARATUS INCLUDING SPARK PLUG THAT GENERATES PLASMA

CROSS-REFERENCE TO RELATED APPLICATION

This application is based on and claims the benefit of priority from earlier Japanese Patent Application No. 2017-44205 filed Mar. 8, 2017, the description of which is incorporated herein by reference.

BACKGROUND

Technical Field

The present disclosure relates to an ignition apparatus.

Related Art

An ignition apparatus generates high-frequency plasma to ignite a mixture of air and fuel. For example, JP-T-2005-536684 discloses an ignition apparatus that includes a coaxial waveguide structure having an inner conductor and an outer conductor whose end projects into a combustion chamber. In the ignition apparatus, electromagnetic wave is applied to the coaxial waveguide structure to generate high potential at the end of inner conductor, thereby producing plasma at the end of the inner conductor, igniting air-fuel mixture in the combustion chamber.

The configuration of JP-T-2005-536684 requires to effectively use energy of electromagnetic wave power to form and expand plasma. However, impedance of apparatus with air-fuel mixture surrounding electrode prior to discharge breakdown is different from impedance of the apparatus after discharge breakdown with plasma present in the vicinity of electrode. Hence, if impedance matching condition for electromagnetic wave power transfer is fulfilled prior to discharge breakdown, this state breaks once the plasma is present in the vicinity of electrode. Due to this impedance mismatch, a part of electromagnetic wave energy is not delivered into discharge and does not contribute to plasma expansion.

In contrast, if the electromagnetic wave is matched with the impedance state after plasma is generated, the electromagnetic wave does not match with the impedance state before plasma is generated. Hence, energy of electromagnetic wave power cannot be effectively used for breakdown of high-frequency plasma. That is, the configuration disclosed in JP-T-2005-536684 does not efficiently use energy of electromagnetic wave energy for generating and expanding plasma. Inefficient electromagnetic wave energy use leads to necessity for high power electromagnetic wave power supply consequent increase in power supply size.

SUMMARY

An embodiment provides an ignition apparatus that ignites mixture by plasma and can effectively use energy of electromagnetic wave power.

As an aspect of the embodiment, an ignition apparatus is provided which ignites a mixture of air and fuel gas by plasma to generate an initial flame. The apparatus includes: a spark plug that includes an inner conductor, a cylindrical outer conductor that holds the inner conductor thereinside, and a dielectric that is located between the inner conductor and the outer conductor, and that generates plasma in a plasma formation space between the inner conductor and the outer conductor; an electromagnetic wave power supply that generates an electromagnetic wave to apply electromagnetic wave power to the spark plug; an evaluation section that evaluates state of the plasma; a determination section that determines optimum matching condition based on information from evaluation section; and a coupled state control section that controls a matching condition of the electromagnetic wave so that the electromagnetic wave matches the matching object.

BRIEF DESCRIPTION OF THE DRAWINGS

In the accompanying drawings:

FIG. 5 C shows a change of detection values of reflected power in a second comparative embodiment;

DETAILED DESCRIPTION OF THE PREFERRED EMBODIMENTS

First Embodiment

An embodiment of an ignition apparatus will be described with reference to FIG. 1 to FIG. 6.

An ignition apparatus 1 of the present embodiment ignites a mixture of air and fuel gas by plasma to form an initial flame.

Figure 1:
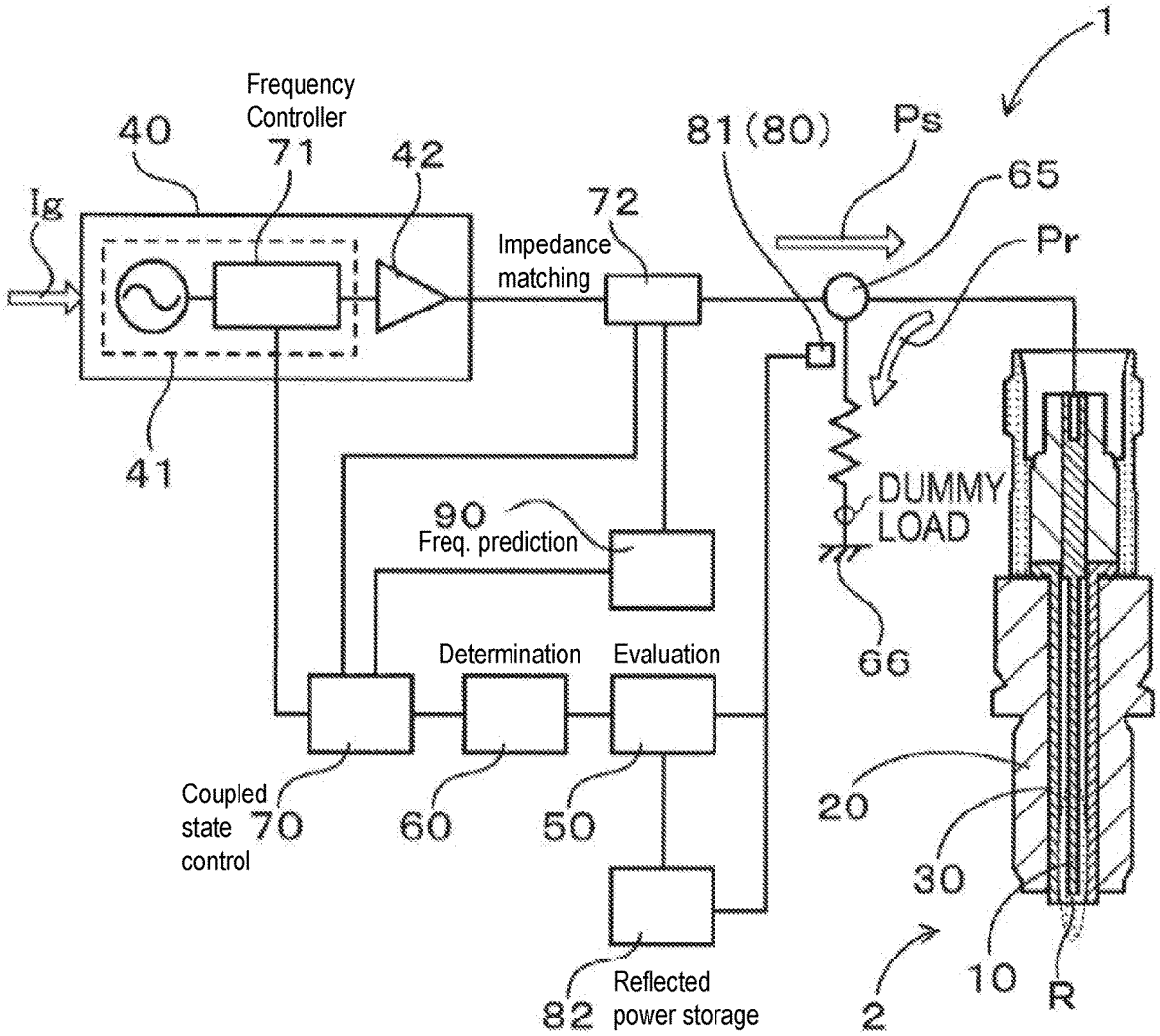
FIG. 1 is a schematic view of an ignition apparatus according to a first embodiment.
Figure 2:
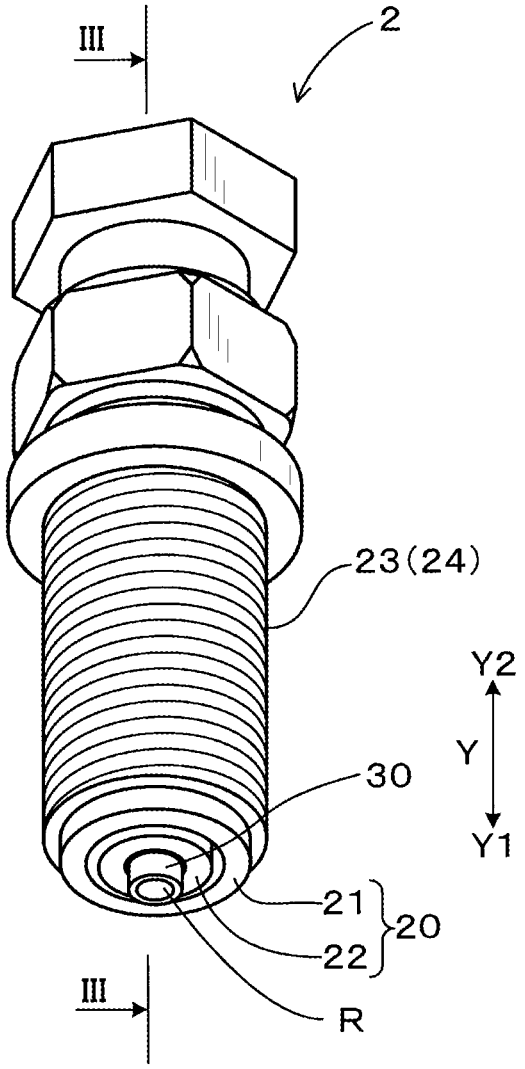
FIG. 2 is a perspective view of a spark plug according to the first embodiment.
Figure 3:
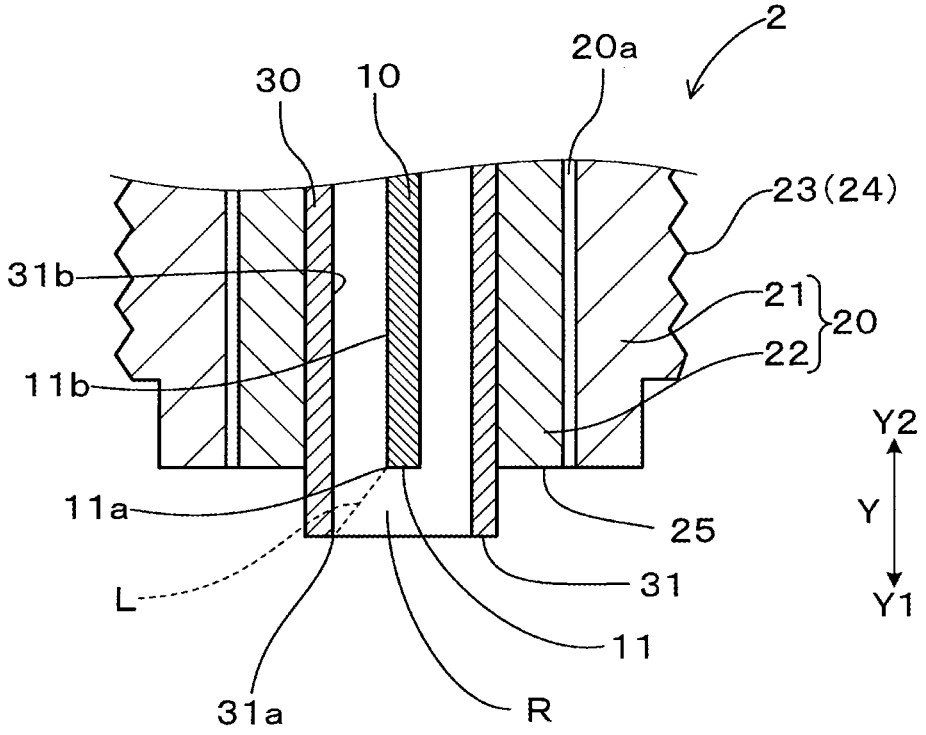
FIG. 3 is a partially enlarged view taken along a line III-III in FIG. 2.

As shown in FIG. 1, the ignition apparatus 1 has a spark plug 2, an electromagnetic wave power supply 40, an evaluation section 50, a determination section 60, and a coupled state control section 70. As shown in FIG. 2 and FIG. 3, the spark plug 2 includes an inner conductor 10, a cylindrical outer conductor 20 that holds the inner conductor 10 thereinside, and a dielectric 30 provided between the inner conductor 10 and the outer conductor 20. The spark plug 2 is configured to generate plasma in a plasma formation space R between the inner conductor 10 and the outer conductor 20.

The electromagnetic wave power supply 40 generates an electromagnetic wave to apply electromagnetic wave power to the spark plug 2.

The evaluation section 50 evaluates state of the plasma.

The determination section 60 determines a matching object of the electromagnetic wave based on the result from the evaluation section 50.

The coupled state control section 70 controls a matching condition of the electromagnetic wave so that the electromagnetic wave matches the matching object.

Hereinafter, the ignition apparatus 1 of the present embodiment will be described in detail.

As shown in FIG. 3, the outer conductor 20 of the spark plug 2 consists of a first outer conductor 21 having a cylindrical shape and a second outer conductor 22 that has a cylindrical shape and is provided inside the first outer conductor 21 so as to share a central axis with the first outer conductor 21. A gap 20*a* is provided between the first outer conductor 21 and the second outer conductor 22. The first outer conductor 21 also serves as a housing 23 of the spark plug 2. A mounting screw portion 24 is formed on the outer peripheral surface of the housing 23 so as to be screwed into an internal-combustion engine.

As shown in FIG. 2, the dielectric 30 has a cylindrical shape, and is provided inside the second outer conductor 22 so as to share the central axis with the first outer conductor 21 and the second outer conductor 22. As shown in FIG. 3, a dielectric end portion 31, which is an end on an end side Y1 of the dielectric 30, is positioned on the end side Y1 with respect to an outer conductor end side 25, which is an end on the end side Y1 of the second outer conductor 22. That is, the dielectric end portion 31 projects on the end side Y1. A material improving electrical field intensity of an inner conductor end portion 11 may be preferably used for the dielectric 30. It is because improving the electrical intensity of an inner conductor end portion 11, which is an end portion on the end side Y1 of the inner conductor 10, easily forms partial discharge between the inner conductor end portion 11 and the dielectric end portion 31. A material having a high dielectric constant (e.g. alumina) can be used for dielectric 30 to improve the electrical intensity of the inner conductor end portion 11.

The inner conductor 10 has a cylindrical shape and is provided inside the dielectric 30 so as to share the central axis with the dielectric 30. The outer diameter of the inner conductor 10 is smaller than the inner diameter of the dielectric 30. An outer peripheral surface 11*b* of the inner conductor 10 and an inner peripheral surface 31*b* of the dielectric 30 are separated from each other. The inner conductor end portion 11 is positioned on a base end side Y2 with respect to the dielectric end portion 31. In addition, the position of the inner conductor end portion 11 in a plug axis direction Y is the same as that of the outer conductor end side 25 of the second outer conductor 22.

For the inner conductor 10, a material having relatively low electrical conductivity or a material partially including the material having relatively low electrical conductivity can be used so that the inner conductor end portion 11 is easily heated. As such a material, for example, a material having electrical conductivity lower than that of copper can be used. It is noted that only the inner conductor end portion 11 may be formed of such a material. Even in this case, the inner conductor end portion 11 can be easily heated.

In addition, for the inner conductor 10, a material easily absorbing high frequency energy or a material partially including the material easily absorbing high frequency energy can be used so that the inner conductor end portion 11 of the inner conductor 10 is easily heated. Alternatively, the outer peripheral surface 11*b* of the inner conductor 10 or the inner peripheral surface 31*b* of the dielectric 30 may be coated with a material easily absorbing high frequency energy so that the inner conductor end portion 11 of the inner conductor 10 is easily heated. For example, carbon can be used as the material easily absorbing high frequency energy. As the material partially including the material easily absorbing high frequency energy, for example, stainless steel (SUS) can be used.

As shown in FIG. 2, the plasma formation space R is surrounded by the inner peripheral surface 31*b* of the dielectric 30, and the inner conductor end portion 11 and the outer peripheral surface 11*b* of the inner conductor 10. The plasma formation space R includes an imaginary line L connecting an outer edge portion 11*a* of the inner conductor end portion 11 and an inner edge portion 31*a* of the dielectric end portion 31. That is, the plasma formation space R separates the inner conductor end portion 11 and the dielectric end portion 31 from each other. It is noted that the length of a coaxial tube, which consists of the inner conductor 10, the outer conductor 20, and the dielectric 30, in the plug axis direction Y can be determined so that the electrical field intensity of an inner conductor end portion 11 becomes maximum. For example, the length of the coaxial tube in the plug axis direction Y can be a quarter of the wavelength of an applied high-frequency wave.

As shown in FIG. 1, the spark plug 2 is connected with the electromagnetic wave power supply 40. The electromagnetic wave power supply 40 has an oscillator 41, and an amplifier 42. The oscillator 41 has a frequency controller 71. When receiving an ignition signal Ig, the electromagnetic wave power supply 40 outputs an electromagnetic wave power Ps having a predetermined frequency in response to the ignition signal Ig. The electromagnetic wave power Ps output from the electromagnetic wave power supply 40 is input to the spark plug 2 through an impedance matching section 72 and a circulator 65. The electromagnetic wave power supply 40 outputs an electromagnetic wave power Ps having a high frequency. The frequency of the electromagnetic wave power Ps is not especially limited, and may be 2.40 to 2.50 GHz. If the frequency of the electromagnetic wave power Ps is 2.40 to 2.50 GHz, which is a frequency of a microwave, the length of a transmission path of the electromagnetic wave power Ps is longer than the wavelength of the electromagnetic wave power Ps. Hence, when there is a discontinuous part of impedance in the transmission path, reflected power Pr is generated, whereby incident power to the spark plug 2 decreases.

The circulator 65 outputs the reflected power Pr from the spark plug 2 only to the dummy load 66. In the present embodiment, the reflected power Pr is detected by a reflected power detection section 81 serving as a detection section 80. The magnitude of the detected reflected power Pr is stored in a reflected power storage section 82.

The evaluation section 50 evaluates state of plasma formation (plasma formation state) in the plasma formation space R between the inner conductor 10 and the outer conductor 20 based on the detection result stored in the reflected power storage section 82. Herein, the plasma formation state includes states concerning formation of plasma, for example, whether or not plasma has been formed in the plasma formation space R, whether or not the formed plasma has been in a expansion stage, and whether or not an initial flame has been formed by the plasma. In the present embodiment, the evaluation section 50 evaluates whether or not high-frequency plasma has been formed based on the magnitude of the reflected power detected by the reflected power detection section 81, whether or not the plasma is in an expansion stage, and whether or not an initial flame has been formed.

The evaluation result by the evaluation section 50 is input to the determination section 60. The determination section 60 determines a matching object of an electromagnetic wave based on the evaluation result. The matching object includes, for example, a mixture gas present in the plasma formation space R between the inner conductor 10 and the outer conductor 20, plasma formed in the plasma formation space R, and an initial flame formed in the plasma formation space R. The determination result by the determination section 60 is input to the coupled state control section 70.

The coupled state control section 70 controls the matching condition based on the determination result by the determination section 60 so that the electromagnetic wave matches the matching object. That is, the coupled state control section 70 changes a frequency f of the electromagnetic wave power Ps or impedance of the transmission path so as to perform impedance matching of the transmission path, which includes the matching object, of the electromagnetic wave power Ps.

In addition, in the present embodiment, the ignition apparatus 1 has a frequency prediction section 90 that predicts a frequency by which impedance matching of the transmission path including the matching object can be performed. The frequency prediction section 90 is configured to be able to predict the frequency based on the driving condition of the vehicle having the internal-combustion engine in which the ignition apparatus 1 is mounted. The frequency prediction section 90 transmits the prediction result to the coupled state control section 70.

In the present embodiment, the coupled state control section 70 operates at least one of the frequency controller 71 and the impedance change section 72 to control the matching state. The frequency controller 71 can change the frequency f of the electromagnetic wave power Ps output from the electromagnetic wave power supply 40. The impedance change section 72 can change impedance of the transmission path of the electromagnetic wave power Ps. The coupled state control section 70 is configured so as to be able to change at least one of the frequency of the electromagnetic wave power Ps and the impedance of the transmission path based on the prediction result by the frequency prediction section 90.

The frequency controller 71 may be configured to control the frequency of output electrical power of a voltage-controlled oscillator by a PLL (Phase Locked Loop) circuit. In addition, the frequency controller 71 may be configured by a circuit (direct control circuit) that directly controls the voltage-controlled oscillator through a D/A converter. For example, the frequency controller 71 may be configured to be able to switch between the PLL circuit and the direct control circuit so that immediately after a frequency change signal is input from the coupled state control section 70 to the frequency controller 71, the frequency controller 71 connects to the direct control circuit to change the frequency desirably, and thereafter the frequency controller 71 connects to the PLL circuit. Accordingly, the frequency can be changed with high speed by the direct control circuit. In addition, after the frequency is changed, the frequency can be stabilized by the PLL circuit.

The impedance change section 72 can be configured to change at least one of inductance and capacitance of the transmission path of the electromagnetic wave power Ps. For example, the impedance change section 72 can be configured by a stub matching unit such as a 2-stub tuner or a 3-stub tuner.

Next, ignition control performed by the ignition apparatus 1 will be described with reference to FIG. 4.

Figure 4:
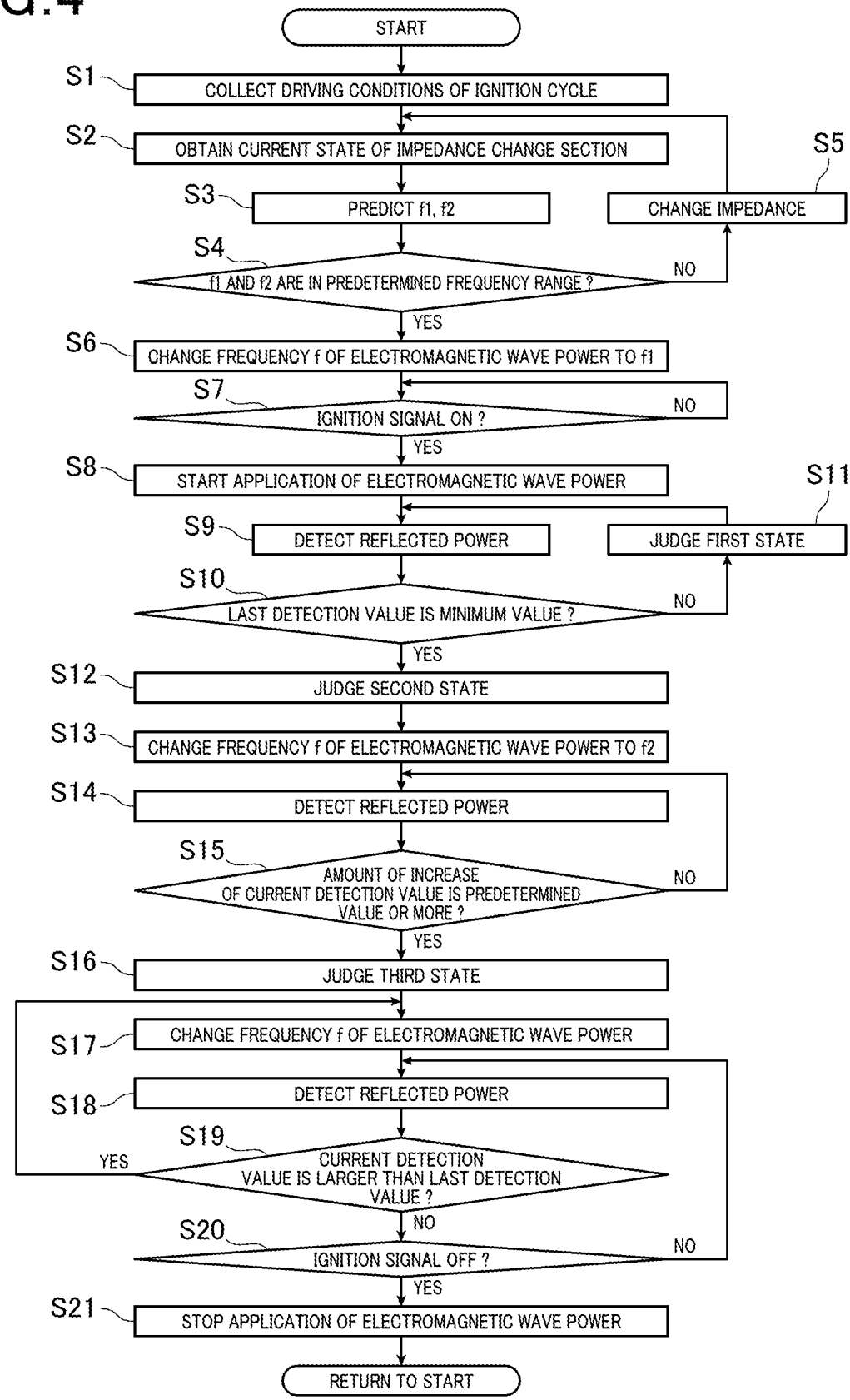
FIG. 4 is a flowchart for illustrating a usage state of the ignition apparatus according to the first embodiment.

First, as shown in FIG. 4, an ignition cycle starts from start. In step S1, driving conditions of the ignition cycle are collected before input of an ignition signal Ig. Next, in step S2, the current state of the impedance change section 72 is obtained.

Thereafter, in step S3, the frequency prediction section 90 predicts a first predicted frequency f1 that matches with impedance of the transmission path in a first state in which plasma is not formed in the plasma formation space R and a second predicted frequency f2 that matches with impedance of the transmission path in a second state in which plasma is formed in the plasma formation space R. That is, the first predicted frequency f1 is predicted when the matching object of the electromagnetic wave is a mixture in the plasma formation space R. The second predicted frequency f2 is predicted when the matching object of the electromagnetic wave is plasma in the plasma formation space R.

Next, in step S4, the frequency prediction section 90 determines whether or not the first predicted frequency f1 and the second predicted frequency f2 predicted in step S3 are in a predetermined range. In the present embodiment, it is determined whether the first predicted frequency f1 and the second predicted frequency f2 are within a range of 2.40 to 2.50 GHz.

If the first predicted frequency f1 and the second predicted frequency f2 are not within the range, in step S35, the coupled state control section 70 operates the impedance change section 72 to change the impedance of the transmission path. Then, the control returns to step S2.

In contrast, in step S4, if the first predicted frequency f1 and the second predicted frequency f2 are within the range, in step S6, the coupled state control section 70 operates the frequency controller 71 to change the frequency f of the electromagnetic wave power Ps output from the electromagnetic wave power supply 40 so as to match with the first predicted frequency f1. That is, the matching object of the electromagnetic wave is set to the mixture in the plasma formation space R.

Next, in step S7, it is determined whether or not the ignition apparatus 1 has received the ignition signal Ig. If the ignition apparatus 1 has not received the ignition signal Ig, step S7 is performed again. If the ignition apparatus 1 has received the ignition signal Ig, in step S8, the electromagnetic wave power supply 40 applies the electromagnetic wave power Ps to the spark plug 2. Since the frequency f of the electromagnetic wave power Ps is set to the first predicted frequency f1, the electromagnetic wave is matched with the mixture in the plasma formation space R, resulting in a first coupling state.

Figure 5A:
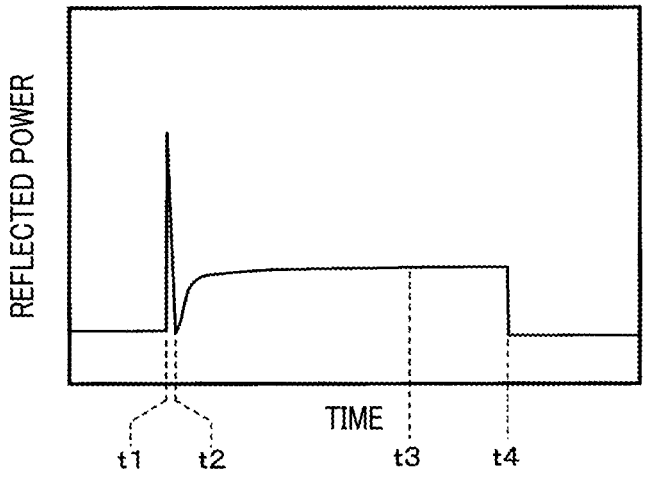
FIG. 5A shows a change of detection values of reflected power in the first embodiment.

Then, in step S9, the reflected power detection section 81 detects the reflected power Pr of the transmission path. The magnitude of the detected reflected power Pr is stored in the reflected power storage section 82. As shown in FIG. 5A, although the reflected power Pr becomes a large value after the start t1 of the application of the electromagnetic wave power Ps, the value decreases shortly.

Thereafter, in step S10, the evaluation section 50 performs comparisons using the reflected power Pr stored in the reflected power storage section 82 to judge whether or not the magnitude of the last reflected power Pr is the minimum value. In the present embodiment, according to a method of determining the minimum value, the magnitude x−2 of the reflected power Pr detected at the time before last, the magnitude x−1 of the reflected power Pr detected at the last time, and the magnitude x of the reflected power Pr detected at the current time are compared with each other. If $x-2>x-1$ and $x>x-1$ are established, it is determined that the magnitude of the reflected power Pr detected at the last time is the minimum value. It is noted that the method of determining the minimum value is not limited to this, and various known methods can be utilized.

In step S10, if it is determined that the magnitude of the reflected power Pr detected at the last time is not the minimum value, in step S11, the evaluation section 50 evaluates that the plasma formation state of the spark plug 2 is the first state in which plasma is not formed in the plasma formation space R. Hence, the state is maintained in which the matching object of the electromagnetic wave is set to the mixture in the plasma formation space R. Then, the control returns to step S9. In the present embodiment, in FIG. 5A, the plasma formation state is judged to be the first state in the time period of t1 to t2.

In contrast, in step S10, if it is determined that the magnitude of the reflected power Pr detected at the last time is the minimum value, in step S12, the evaluation section 50 evaluates the plasma formation state of the spark plug 2 to be the second state in which plasma is formed in the plasma formation space R. Then, in step S13, the coupled state control section 70 operates the frequency controller 71 to change the frequency f of the electromagnetic wave power Ps output from the electromagnetic wave power supply 40 to the second predicted frequency f2. Hence, the matching object of the electromagnetic wave is set to the plasma formed in the plasma formation space R, whereby the electromagnetic wave is matched with the plasma, resulting in a second coupling state.

In the present embodiment, it is judged that the reflected power becomes the minimum value at time point t2 in FIG. 5A, and plasma is formed in the plasma formation space R at t2. Hence, the time period of t1 to t2 is in the first state and indicates a delay time of the plasma formation with respect to the application of the electromagnetic wave power Ps.

Thereafter, in step S14, the reflected power detection section 81 detects the reflected power Pr and stores it in the reflected power storage section 82. Then, in step S15, the evaluation section 50 compares the current reflected power Pr detected by the reflected power detection section 81 with the last reflected power Pr stored in the reflected power storage section 82 to and evaluates whether or not the amount of increase of the current reflected power Pr is a predetermined value or more. If it is judged that the amount of increase of the current reflected power Pr is not the predetermined value or more, the control returns to step S14. In contrast, if it is judged that the amount of increase of the current reflected power Pr is the predetermined value or more, in step S16, the evaluation section 50 evaluates the plasma formation state to be the third state in which an initial flame is formed by plasma.

Then, in step S17, the coupled state control section 70 operates the frequency controller 71 to change the frequency f of the electromagnetic wave power Ps output from the electromagnetic wave power supply 40 within the predetermined range. Then, in step S18, the reflected power detection section 81 detects the reflected power Pr. In step S19, the evaluation section 50 evaluates whether or not the detection value of the current reflected power Pr is larger than the detection value of the last reflected power Pr. If it is judged that the detection value of the current reflected power Pr is larger than the detection value of the last reflected power Pr, the control returns to S17, in which the frequency f of the electromagnetic wave power Ps is changed again to perform feedback control so that the reflected power does not increase. Hence, the matching condition of the electromagnetic wave is set to the initial flame, and the electromagnetic wave is matched with the initial flame, whereby a third coupling state is maintained. In the present embodiment, at time point t3 shown in FIG. 5A, the plasma formation state is judged to be the third state, and the feedback control is performed.

In contrast, in step S19, if it is judged that the detection value of the current reflected power Pr is not larger than the detection value of the last reflected power Pr, in step S20, it is judged whether the ignition signal Ig is in an off state. If the ignition signal Ig is not in an off state, that is, if the ignition signal Ig is being received, the control returns to step S18. If the ignition signal Ig is in an off state, that is, if the ignition signal Ig is not being received, in step S21, the application of the electromagnetic wave power Ps by the electromagnetic wave power supply 40 is stopped, and then the control returns to start. In the present embodiment, at time point t4 shown in FIG. 5A, the application of the electromagnetic wave power Ps is stopped. That is, the electromagnetic wave power Ps is applied during the time period between t1 and t4.

Regarding the ignition apparatus that ignites a mixture by plasma, the following are known. That is, after the application of the electromagnetic wave power starts, in the course of storing the energy of the electromagnetic wave power in the plasma formation space between the inner conductor and the outer conductor or to the end of the inner conductor, the reflected power temporarily increases. Then, consuming the energy stored in the course of forming plasma suddenly decreases the reflected power. Thereafter, due to the change of load impedance along with the shift to a plasma expansion process, the reflected power increases again.

The changes in the detection values of the reflected power in the ignition cycle of the ignition apparatus 1 of the present embodiment and comparative embodiments are as below. In the ignition apparatus 1 of the present embodiment, although the reflected power Pr first suddenly increases after start t1, which is after the initial state before the application of the electromagnetic wave power Ps starts and at which the application starts, the reflected power Pr rapidly decreases and becomes the minimum value at t2. Immediately after t2, although the reflected power suddenly increases again, the magnitude thereof is smaller than that at immediately after t1. Thereafter, the reflected power gradually increases until t3, and is kept substantially constant during the time period of t3 to t4. Then, after t4, the reflected power returns to the state before the application of the electromagnetic wave power Ps starts.

In the first comparative embodiment, in the configuration similar to that of the ignition apparatus 1, the electromagnetic wave power whose frequency is set so as to match the impedance of the transmission path in the state before plasma is formed, that is, in the first state, is continuously applied to the spark plug 2 from the start t1 of the application to the stop t4 of the application. In the first comparative embodiment, during the time period of t1 to t2 shown in FIG. 5B, as in the case of the present embodiment shown in FIG. 5A, after the reflected power increases at t1 at which the electromagnetic wave power is applied, the reflected power rapidly decreases and becomes the minimum value at t2. During the time period of t2 to t4 shown in FIG. 5B, compared with the case of the present embodiment shown in FIG. 5A, the reflected power becomes a large value over the time period.

In addition, in the second comparative embodiment, in the configuration similar to that of the ignition apparatus 1, the electromagnetic wave power whose frequency is set so as to match the impedance of the transmission path in the state after plasma is formed and before an initial flame is formed, that is, in the second state, is continuously applied to the spark plug 2 from the start t1 of the application to the stop t4 of the application. In the second comparative embodiment, during the time period t1 to t2 shown in FIG. 5C, the reflected power becomes a value larger than that in the present embodiment shown in FIG. 5A. In addition, time point P2 at which the reflected power becomes the minimum value is later than that in the case of the present embodiment shown in FIG. 5A, whereby plasma breakdown delay time, which is the time period from the start of the application of the electromagnetic wave power to the completion of formation of plasma, becomes longer. In addition, during the time period of t2 to t3, the increasing state of the reflected power immediately after t2 is similar to that of the present embodiment shown in FIG. 5A. However, after the reflected power suddenly increases at t3 shown in FIG. 5C, the reflected power decreases until t4 at which the application of the electromagnetic wave power ends.

Figure 5B:
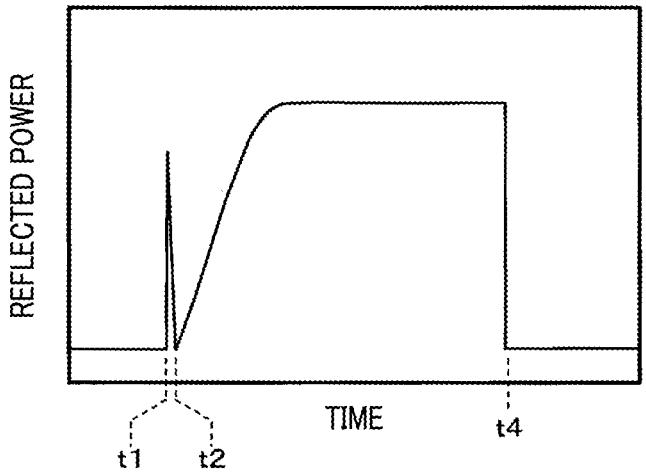
FIG. 5 B shows a change of detection values of reflected power in a first comparative embodiment.
Figure 5C:
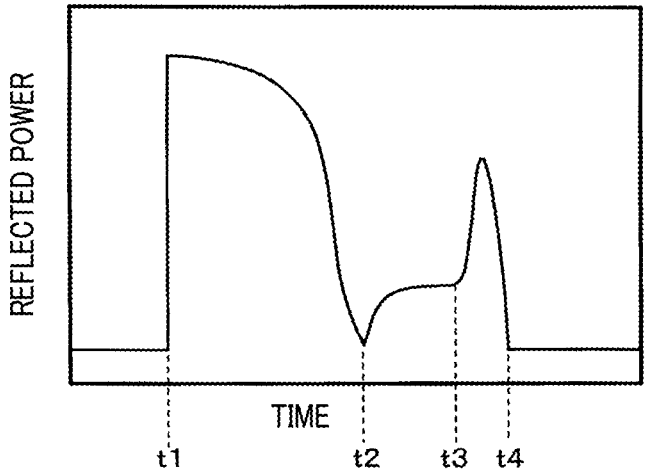

According to the comparison between the present embodiment and the first comparative embodiment, in the case of the present embodiment shown in FIG. 5A, the detection value of the reflected power is small during the time periods of t2 to t3 and t3 to t4 compared with the case in the first comparative embodiment shown in FIG. 5B. Hence, it can be assumed that, during the time periods, the energy of the electromagnetic wave power is effectively used for the plasma expansion and the formation of the initial flame. According to the comparison between the present embodiment and the second comparative embodiment, in the case of the present embodiment shown in FIG. 5A, the detection value of the reflected power is small during the time period of t1 to t2 compared with the case in the second comparative embodiment shown in FIG. 5C. Hence, it can be assumed that the energy of the electromagnetic wave power is effectively used for the formation of plasma. In addition, the reflected power does not greatly increase also during the time period of t3 to t4 compared with the case in the second comparative embodiment. Hence, it can be assumed that, also during the time period, the energy of the electromagnetic wave power is effectively used for the formation of the initial flame.

Figure 6:
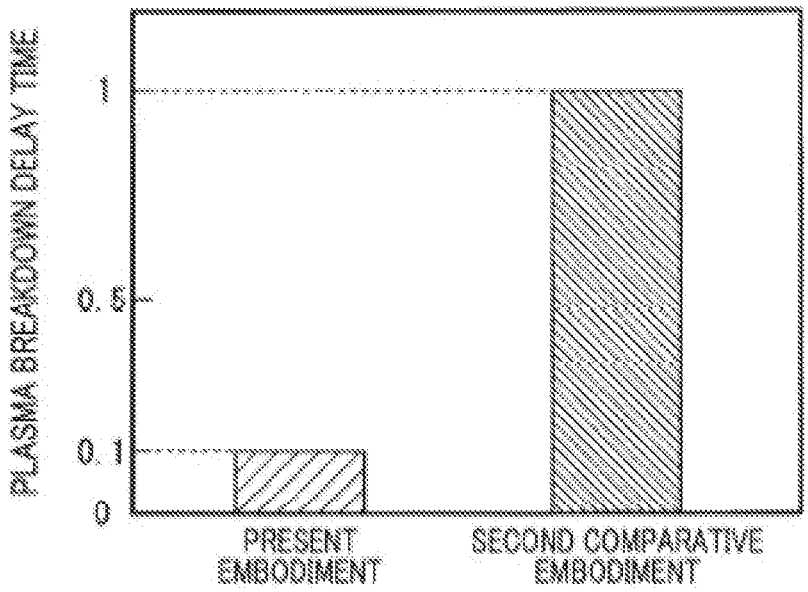
FIG. 6 is a diagram comparing delay time of plasma breakdown between the first embodiment and the second comparative embodiment.

In addition, according to the comparison between the present embodiment and the second comparative embodiment concerning the plasma breakdown delay time of t1 to t2, as shown in FIG. 6, if the plasma breakdown delay time of t1 to t2 of the second comparative embodiment is assumed to be 1, the plasma breakdown delay time of t1 to t2 of the present embodiment is 0.1. Hence, the plasma breakdown delay time of t1 to t2 of the present embodiment is sufficiently short compared with the second comparative embodiment. Also according to this, it can be assumed that the energy of the electromagnetic wave power is effectively used for the formation of plasma.

Hereinafter, effects of the ignition apparatus 1 of the present embodiment will be described in detail.

According to the ignition apparatus 1 of the present embodiment, a matching object of the electromagnetic wave is determined based on the evaluation result on the plasma formation state as described above. Then, the matching condition of the electromagnetic wave is controlled so that the electromagnetic wave matches the matching object. Hence, the matching condition of the electromagnetic wave can be optimum according to the change of the plasma formation state, whereby the energy of the electromagnetic wave power can be effectively used for forming plasma. Accordingly, a reduction in power consumption, an improvement in fuel consumption, and a decrease in size of the electromagnetic wave power supply 40 can be achieved.

In addition, in the present embodiment, if the evaluation section 50 evaluates the plasma formation state to be the first state in which plasma is not generated in the plasma formation space R between the inner conductor 10 and the outer conductor 20, the determination section 60 determines that the matching object is a mixture present in the plasma formation space R. If the evaluation section 50 evaluates the plasma formation state to be the second state in which plasma is generated in the plasma formation space R between the inner conductor 10 and the outer conductor 20, the determination section 60 determines that the matching object is plasma present in the plasma formation space R. Hence, since the electromagnetic wave can be matched in respective states suitable for the first state and the second state, the energy of the electromagnetic wave power can be effectively used for plasma formation and plasma expansion.

In addition, in the present embodiment, the detection section 80 is provided which detects the reflected power Pr from the spark plug 2. The evaluation section 50 evaluates state of formation of plasma based on the detection result by the detection section 80. Hence, presence or absence of impedance mismatching of the transmission path of the electromagnetic wave power Ps can be detected with high accuracy. The electromagnetic wave can be matched in the respective states more suitable for the first state and the second state. It is noted that although the detection object of the detection section 80 is the reflected power Pr in the present embodiment, instead of this or in addition to this, the detection object may be at least one of incident power to the spark plug 2, and a detection voltage and a detection current for detecting the incident power or the reflected power. It is noted that since the frequency of an electromagnetic wave is high, obtaining the instantaneous value thereof to control a matching condition is disadvantageous to the cost and is practically difficult in a certain frequency band. However, if the detection object is a detection voltage or a detection current, the matching condition can be controlled at low cost. Specifically, when an electromagnetic wave having a high frequency of the RF band level is used, if the detection object is a detection voltage or a detection current, the responsibility in measurement is sufficiently high. Hence, high reliability and availability can be obtained.

In addition, in the present embodiment, the detection section 80 detects the reflected power Pr. When the reflected power Pr detected by the detection section 80 becomes the minimum value for the first time from the start t1 of the application of the electromagnetic wave power Ps, the evaluation section 50 evaluates that plasma has generated in the plasma formation space R. Hence, the generation of plasma in the plasma formation space R can be judged accurately.

In addition, in the present embodiment, if the evaluation section 50 evaluates the plasma formation state to be the third state in which an initial flame is formed by plasma, the determination section 60 determines that the matching object is the initial flame. Since the initial flame is formed by chemical species different from plasma, load impedance thereof also differs from that of plasma. According to the above, after the initial flame is formed, energy of the electromagnetic wave power Ps can be applied to the initial flame. Hence, the energy of the electromagnetic wave power Ps can be utilized more effectively, whereby the growth of the initial flame can be advanced to improve ignitability.

In addition, in the present embodiment, the frequency controller 71 that changes the frequency f of the electromagnetic wave power Ps is provided. The coupled state control section 70 operates the frequency controller 71 to change the frequency f of the electromagnetic wave power Ps, thereby controlling the matching condition of the electromagnetic wave so that the electromagnetic wave matches the matching object. Hence, the electromagnetic wave easily matches the matching object.

In addition, in the present embodiment, the impedance change section 72 that changes impedance of the transmission path of the electromagnetic wave power Ps is provided. The coupled state control section 70 operates the impedance change section 72 to change the impedance of the transmission path, thereby controlling the matching condition so that the electromagnetic wave matches the matching object. Also in this case, the electromagnetic wave easily matches the matching object.

In addition, in the present embodiment, the frequency controller 71 that changes the frequency f of the electromagnetic wave power Ps and the impedance change section 72 that changes impedance of the transmission path of the electromagnetic wave power Ps are provided. After the coupled state control section 70 operates the impedance change section 72 to change the impedance of the transmission path so that the frequency of the electromagnetic wave when the electromagnetic wave matches the matching object is within a predetermined range in which the frequency controller 71 can control the frequency, the coupled state control section 70 operates the frequency controller 71 to change the frequency of the electromagnetic wave within the predetermined range, thereby controlling the matching condition of the electromagnetic wave so that the electromagnetic wave matches the matching object. In the present embodiment, the predetermined range of the frequency is 2.40 to 2.50 Ghz. Typically, when the impedance change section 72 changes impedance, although long time is required, the range of the change is wide. When the frequency controller 71 changes the frequency, although the change can be performed quickly, the range of the change is narrow. Hence, the configuration described above is used to change the impedance by the impedance change section 72 as described above before the electromagnetic wave power Ps is applied and to change the frequency by the frequency controller 71 while the electromagnetic wave power Ps is being applied. Thereby, the electromagnetic wave can be matched with the matching object quickly and accurately while the controllable range of the frequency is widened.

In addition, in the present embodiment, the impedance change section 72 is configured to change at least one of inductance and capacitance of the transmission path. Hence, when the impedance change section 72 changes the impedance to change the reactance, the resonance part is changed, whereby the matching condition can be adjusted. Hence, the matching condition can be adjusted in a wider range.

As described above, according to the present embodiment, the ignition apparatus 1 can be provided which can effectively use the energy of the electromagnetic wave power Ps.

Second Embodiment

Figure 7:
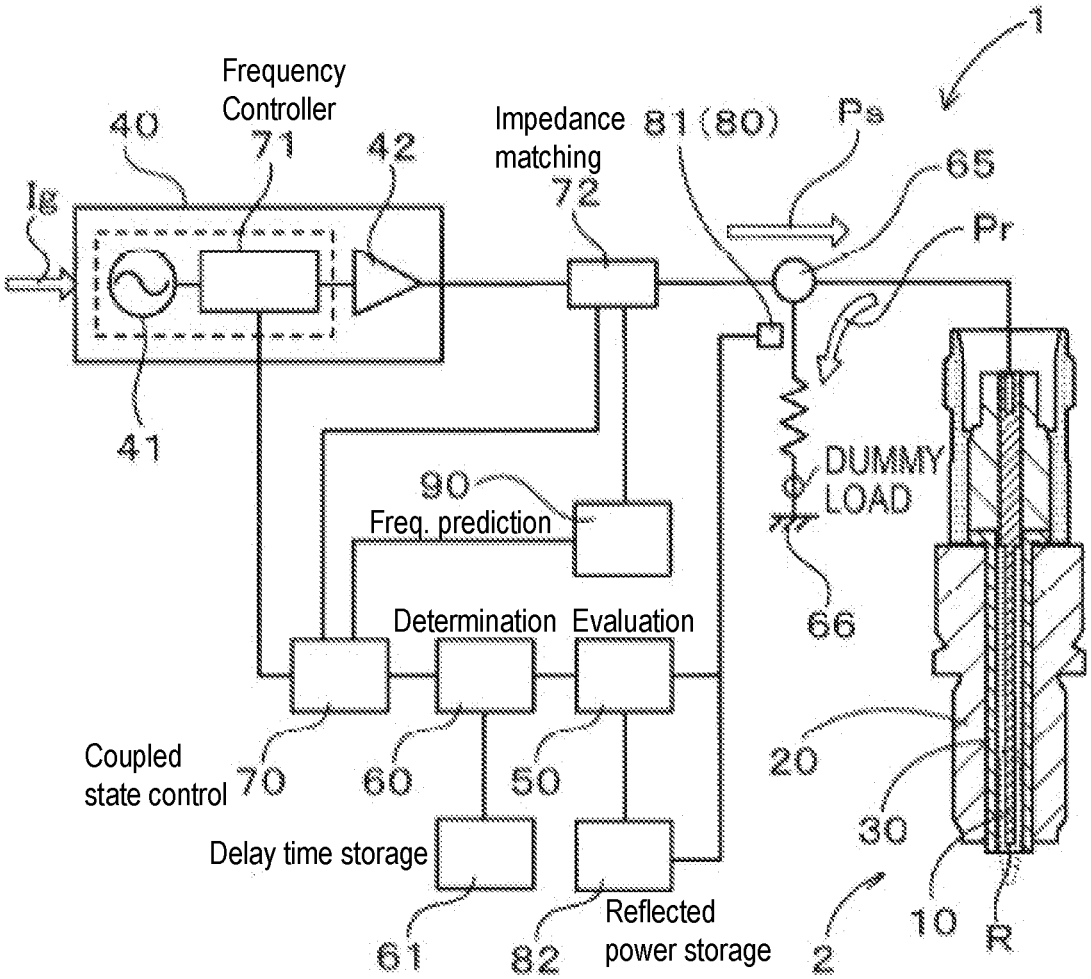
FIG. 7 is a schematic view of an ignition apparatus according to a second embodiment.

As shown in FIG. 7, the ignition apparatus 1 of the present embodiment has, in addition to the configuration of the first embodiment, a delay time storage section 61. The delay time storage section 61 stores plasma breakdown delay time that is previously set. The plasma breakdown delay time is the time period from the start t1 of the application of the electromagnetic wave power Ps to the spark plug 2 to the time t2 at which plasma is formed. The plasma breakdown delay time changes depending on a gas density in the plasma formation space R in which plasma is formed. Then, the gas density in the plasma formation space R is determined by in-cylinder pressure and in-cylinder temperature at ignition timing determined from the driving condition of the internal-combustion engine provided with the ignition apparatus 1. In the present example, the plasma breakdown delay time is defined as a map value of the driving condition. Other components of the present embodiment are similar to those of the first embodiment. Also in the present embodiment, the same reference signs as those in the first embodiment are used to omit redundant descriptions.

Figure 8:
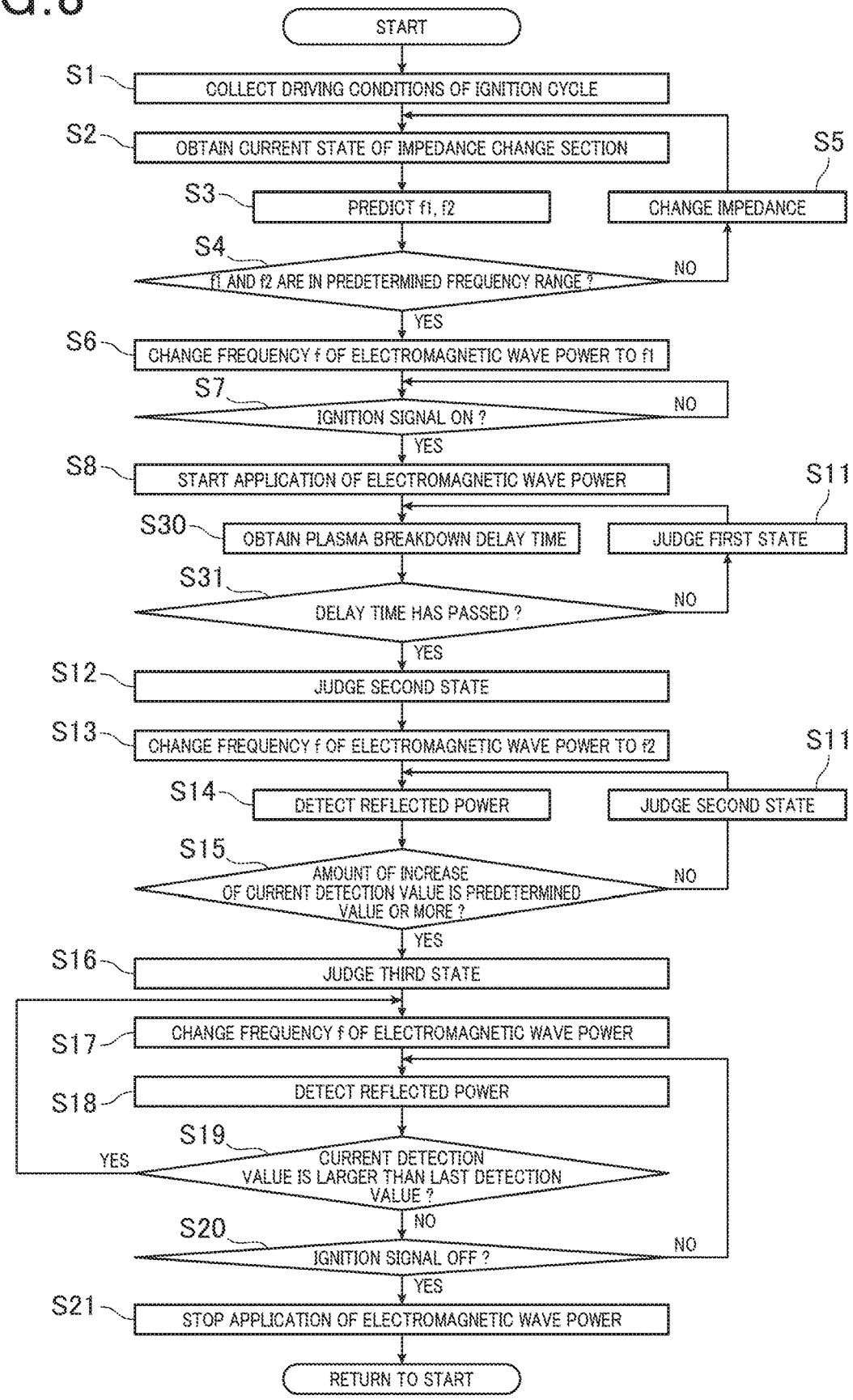
FIG. 8 is a flowchart for illustrating a usage state of the ignition apparatus according to the second embodiment.

The ignition cycle of the ignition apparatus 1 of the present embodiment will be described with reference to FIG. 8. As shown in FIG. 8, steps S1 to S8 are similar to those in the first embodiment. Then, after step S8, in step S30, the evaluation section 50 obtains the plasma breakdown delay time corresponding to the driving condition collected, in step S1, from the map stored in the delay time storage section 61. Thereafter, in step S31, it is determined whether or not the plasma breakdown delay time obtained in step S30 has passed from the application start t1. If it is determined that the plasma breakdown delay time has not passed, in step S11, the first state is judged by the evaluation section 50. Then, the control returns to S31. In contrast, if it is determined that the plasma breakdown delay time has passed, in step S12, the second state is judged by the evaluation section 50. The later steps S13 to S21 are similar to those of the first embodiment.

According to the ignition apparatus 1 of the present embodiment, the evaluation section 50 evaluates the plasma formation state to be the first state during a predetermined time period from the start t1 of the application of power to the spark plug 2, that is, until the plasma breakdown delay time passes, and to be the second state after the plasma breakdown delay time passes. Hence, the evaluation of the first state becomes easy. The present embodiment provides other effects similar to those of the first embodiment.

It is noted that, also in the present embodiment, as in the first embodiment, it may be determined whether plasma has been formed based on the detection result by the detection section 80. For example, in the internal-combustion engine in which the ignition apparatus 1 is mounted, pressure or temperature in the cylinders easily varies in the transition range when the driving condition is changed, whereby variation in statistical delay in plasma formation may be caused. In such a case, as in the first embodiment, it may be determined whether plasma has been formed based on the detection result by the detection section 80.

It will be appreciated that the present invention is not limited to the configurations described above, but any and all modifications, variations or equivalents, which may occur to those who are skilled in the art, should be considered to fall within the scope of the present invention.

Hereinafter, an aspect of the above-described embodiments will be summarized.

As an aspect of the embodiment, an ignition apparatus (1) is provided which ignites a mixture of air and fuel gas by plasma to generate an initial flame. The apparatus includes: a spark plug (2) that includes an inner conductor (10), a cylindrical outer conductor (20) that holds the inner conductor thereinside, and a dielectric (30) that is provided between the inner conductor and the outer conductor, and that generates plasma in a plasma formation space (R) between the inner conductor and the outer conductor; an electromagnetic wave power supply (40) that generates an electromagnetic wave to apply electromagnetic wave power (Ps) to the spark plug; an evaluation section (50) that evaluates a state of formation of the plasma; a determination section (60) that determines a matching object of the electromagnetic wave based on an evaluation result by the evaluation section; and a coupled state control section (70) that controls a matching condition of the electromagnetic wave so that the electromagnetic wave matches the matching object.

According to the ignition apparatus, the matching object of the electromagnetic wave is determined based on the evaluation result on the state of formation of the plasma. Then, the matching condition of the electromagnetic wave is controlled so that the electromagnetic wave matches the matching object. Hence, the matching condition of the electromagnetic wave can be optimum according to the change of the state of formation of the plasma, whereby the energy of the electromagnetic wave power can be effectively used for forming plasma. Accordingly, a reduction in power consumption, an improvement in fuel consumption, and a decrease in size of the electromagnetic wave power supply can be achieved.

As described above, according to the embodiment, an ignition apparatus that can effectively use energy of electromagnetic wave power can be provided.

What is claimed is:

1. An ignition apparatus that ignites a mixture of air and fuel gas by plasma to generate an initial flame, the apparatus comprising:

a spark plug that includes an inner conductor, a cylindrical outer conductor that holds the inner conductor thereinside, and a dielectric that is provided between the inner conductor and the outer conductor, and that generates plasma in a plasma formation space between the inner conductor and the outer conductor;

an electromagnetic wave power supply that generates an electromagnetic wave to apply electromagnetic wave power to the spark plug;

an evaluation section that evaluates a state of formation of the plasma;

a determination section that determines a matching object of the electromagnetic wave based on an evaluation result by the evaluation section; and a coupled state control section that controls a matching condition of the electromagnetic wave so that the electromagnetic wave matches the matching object, wherein when the evaluation section evaluates that the state of formation of the plasma to be a first state in which the plasma is not generated in the plasma formation space, the determination section determines that the matching object is the mixture present in the plasma formation space, and when the evaluation section evaluates that the state of formation of the plasma to be a second state in which the plasma is generated in the plasma formation space, the determination section determines that the matching object is the plasma present in the plasma formation space.

2. The ignition apparatus according to claim 1, wherein the evaluation section evaluates the first state from start of application of power to the spark plug and until a predetermined time period passes, and evaluates the second state after the predetermined time pass has passed.

3. The ignition apparatus according to claim 1, further comprising a detection section that detects at least one of reflected power from the spark plug, incident power to the spark plug, and a detection voltage and a detection current for detecting the reflected power or the incident power, wherein the evaluation section evaluates the state of formation of the plasma based on a detection result by the detection section.

4. The ignition apparatus according to claim 3, wherein the detection section detects the reflected power, and when the reflected power detected by the detection section become a minimum value for the first time from a start of the application of the electromagnetic wave power, the evaluation section evaluates that the plasma has generated in the plasma formation space.

5. The ignition apparatus according to claim 1, wherein if the evaluation section evaluates the state of formation of the plasma to be a third state in which an initial flame is formed by the plasma, the determination section determines that the matching object is the initial flame.

6. The ignition apparatus according to claim 1, further comprising a frequency controller that changes a frequency of the electromagnetic wave, wherein the coupled state control section operates the frequency controller to change a frequency of the electromagnetic wave to control a matching condition of the electromagnetic wave so that the electromagnetic wave matches the matching object.

7. The ignition apparatus according to claim 1, further comprising an impedance change section that changes impedance of a transmission path of the electromagnetic wave, wherein the coupled state control section operates the impedance change section to change the impedance of the transmission path to control the matching condition so that the electromagnetic wave matches the matching object.

8. The ignition apparatus according to claim 1, further comprising a frequency controller that changes a frequency of the electromagnetic wave; and an impedance change section that changes impedance of a transmission path of the electromagnetic wave, wherein after the coupled state control section operates the impedance change section to change the impedance of the transmission path so that the frequency of the electromagnetic wave when the electromagnetic wave matches the matching object is within a predetermined range in which the frequency controller controls the frequency, the coupled state control section operates the frequency controller to change the frequency of the electromagnetic wave within the predetermined range, to control the matching condition of the electromagnetic wave so that the electromagnetic wave matches the matching object.

9. The ignition apparatus according to claim 7, wherein the impedance change section changes at least one of inductance and the capacitance of the transmission path.

10. The ignition apparatus according to claim 1, wherein the determination section is configured to determine that the matching object includes a mixture gas present in the plasma formation space.

11. The ignition apparatus according to claim 1, wherein the determination section is configured to determine that the matching object includes a plasma formed in the plasma formation space.

12. The ignition apparatus according to claim 1, wherein the determination section is configured to determine that the matching object includes an initial flame formed in the plasma formation space.

13. The ignition apparatus according to claim 1, further comprising:

a detector configured to detect an a reflected power;

wherein the evaluation section evaluates the state of formation of the plasma based on the detected reflected power.

* * * * *